United States Patent [19]

Hellström et al.

[11] 4,023,605

[45] May 17, 1977

[54] METHOD FOR GRADING AND MEASURING LUMBER AND A TRIMMING DEVICE FOR PERFORMING SAID METHOD

[75] Inventors: Nils Erik Hellström, Nyland; Bengt Artur Berg, Bollstabruk, both of Sweden

[73] Assignee: A B Hammars Mekanisha Verkstad, Nyland, Sweden

[22] Filed: Apr. 25, 1975

[21] Appl. No.: 571,570

[30] Foreign Application Priority Data

May 8, 1974 Sweden ..... 7406147

[52] U.S. Cl. ..... 144/312; 83/419; 83/467 R; 83/732

[51] Int. Cl.[2] ..... B27B 1/00; B27B 5/06; B27B 31/04

[58] Field of Search ..... 83/425.1, 419, 467, 83/732; 144/312, 326 R, 242 G, 245 A

[56] References Cited

UNITED STATES PATENTS

| | | | |
|---|---|---|---|
| 3,565,140 | 2/1971 | Jacobsen | 144/312 X |
| 3,756,297 | 9/1973 | Heikinheimo | 144/312 |
| 3,759,384 | 9/1973 | Holmberg | 144/312 X |
| 3,856,061 | 12/1974 | Miles | 144/312 |

*Primary Examiner*—Gary L. Smith
*Attorney, Agent, or Firm*—Silverman & Cass, Ltd.

[57] ABSTRACT

Method and apparatus for trimming and grading lumber during transport thereof along a conveyor through a trimming device in which the lumber is cut at both root and top ends; said method comprising, arranging the lumber transverse a conveyor, initially cutting at the root end, directing the remanent transversely of the conveyor to a stop positioned to intercept the top end thereof and located less than one multiple of a length module unit, directing the remanent in the return transverse direction to one of a plurality of finger members, each located one length module from the other in a row transverse the conveyor, making the first top end cut, turning the remanent about its axis for inspection of all sides thereof and directing the remanent to a second cutter for a final top end cut determined by the number of length module units desired, the selection of length being controlled by adjustable stop means.

15 Claims, 2 Drawing Figures

1
2
3
4
5
6
7
8
9
10
11
12
13
14
15
16
17
18
19
20
21
22
23
24
25
26
27
27a
27b
27c
27d
27e
28
a
B

METHOD FOR GRADING AND MEASURING LUMBER AND A TRIMMING DEVICE FOR PERFORMING SAID METHOD

The present invention relates to a method for grading and measuring lumber, preferably boards and planks, during their transport through a trimming device. The invention also relates to a trimming device for performing said method.

In grading and measuring pieces of lumber during their transport through a trimming device it is previously known first to cut the root ends off the pieces of lumber in order to adjust these ends. Thereafter the lumber is transported by a transversely directed roller conveyor to a side stop, and thereafter to another transversely directed roller conveyor combined with measurement flaps. A grader is inspecting the lumber and decides where the pieces are to be cut. Depending thereon he also adjusts one of a number of end stops arranged in combination with a third transversely directed roller conveyor, which feeds the root ends of the lumber pieces against the chosen end stop whereafter top ends cuts are made. When measured from the root end surfaces the lumber will have a length which is the same as a multiple of a length module unit, which consequently does not happen until the lumber has passed to top end cutter blade arranged as the last process station. Every piece will be fed three times in the transverse direction of the trimming device.

It is an object of the present invention to provide a method by which it is possible to let only those pieces of lumber, which at the grading are found to be defect or of an inferior quality, be fed three times in the transverse direction of the trimming device while all the rest of the lumber can pass through the trimming device only with two transverse feedings which will make the work procedure simplified and faster. Furthermore, the method according to the invention makes it possible, when there are defects, inferior quality etc., to make the determination or measurement of the length of a piece of lumber, the top of which is to be cut, from the top surface of the lumber.

This is accomplished by a method for grading and measuring lumber, preferably boards and planks, during their transport through a trimming device, in which the lumber is cut at the root and top ends, said method being characterized by the fact, that the lumber, such as a piece of board, immediately after the root end cut by top cutting by less than one length module unit, is given a length that is exactly one multiple of the length module unit, the piece of board thereafter being transported to a turning device, where all sides of the board are inspected, which is known per se, the piece of board thereafter either being transported out of the trimming device, or, if additional top end cutting is required, being transported with its top end surface against a locating stop, which is chosen with regard to the required length of the top end cut and which is set into an active position, said locating stop being brought to follow the top end surface under continuous contact for axial guidance of the piece of board, said piece of board thereafter being transported to and cut by a cutting device, such as a cutter blade, said cutting device being arranged in a vertical plane at a distance of one or several length module units from the stopping plane of the guiding locating stop.

A trimming device for performing said method and comprising a transverse conveyor, a root end cutter blade, top end cutter blades, transversely directed roller conveyors, measurement flaps, end stops and a turning device is characterized by the fact that said trimming device in its transport direction is provided with in turn a transversely directed roller conveyor located immediately before the root end cutter blade, which is located at one side of the transverse conveyor, a stop located in the transport direction of said transversely directed roller conveyor at the other side of said transverse conveyor, a line of measurement flaps, said line extending transversly across said transverse conveyor, said flaps being swingable upwards and downwards relative to the transport plane of said transverse conveyor and spaced by a distance of one length module unit, said said flaps being provided with electric switch means, a transversely directed roller conveyor arranged in combination with said measurement flaps and having its transport direction away from said stop, a top end cutter blade located at the same side as said stop, the plane of said top end cutter blade being parallel to and at a distance less than one length module unit from the plane of said stop in the transverse direction of the plane, a turning device, adjacent to said turning device a line of measurement flaps which are swingable upwards and downwards, said flaps being spaced by a distance of one length module unit, a transversely directed additional roller conveyor in the transport direction of which and outside of said transverse conveyor a line of locating stops are located, that locating stop which is most adjacent to said transverse conveyor lying in the same plane as said top end cutter blade, said locating stops being spaced by a distance of one length module unit and each locating stop being moveable in the longitudinal direction of said transverse conveyor and provided with means which can be swung upwards and downwards and brought into or out of an active stopping position for a piece of board, and a top end cutter blade located substantially in the same plane as the locating stop which is located most adjacent said transverse conveyor.

The method according to the invention and the trimming device for performing said method will be closer explained below in connection with a description of an embodiment of the invention shown in the attached drawing.

Figures 1, 2:
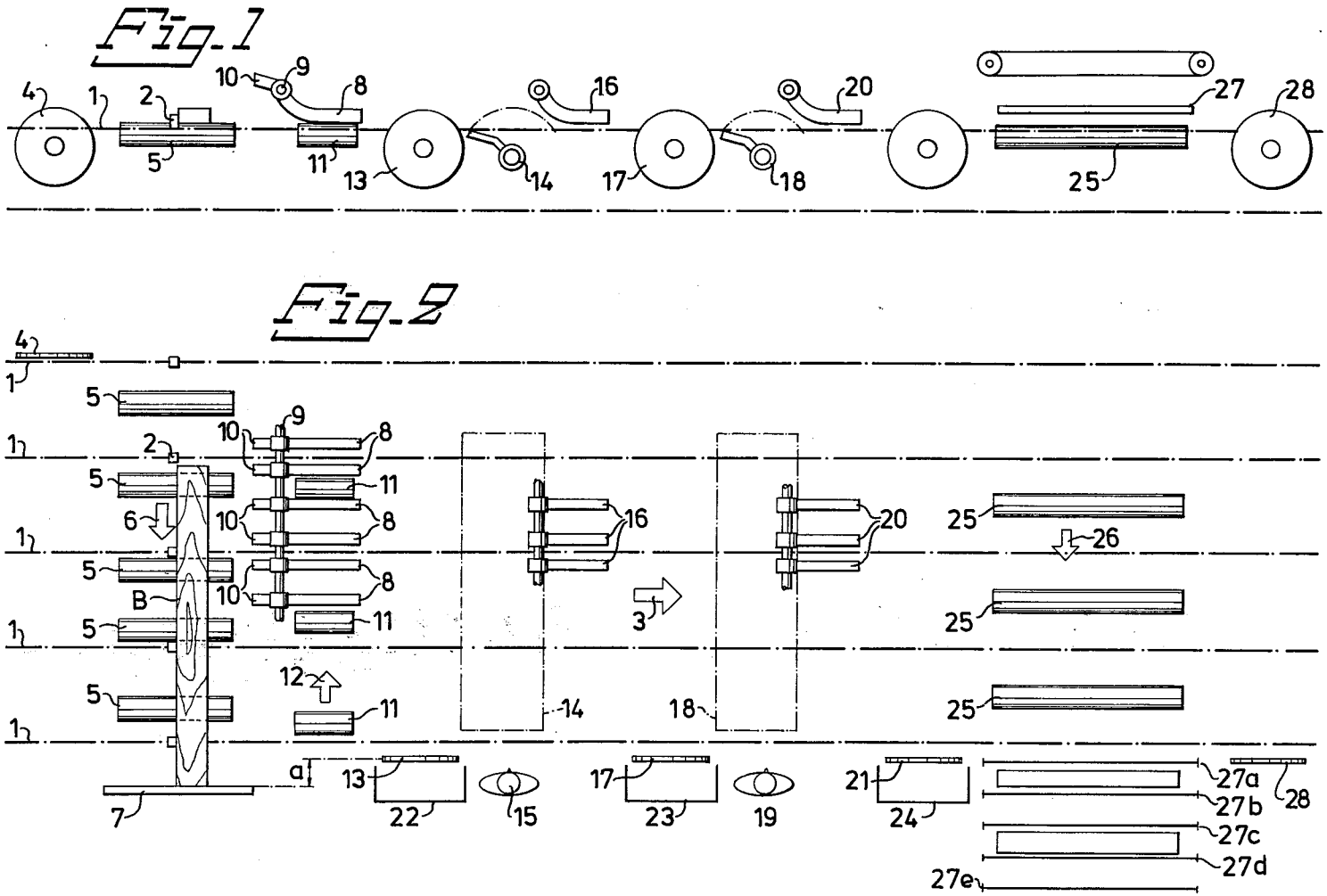
FIG. 1 shows schematically a side view of a trimming device according to the invention, in which the frame supporting the movable parts is omitted for the sake of clarity.
FIG. 2 shows a plane view of the trimming device in which the supporting frame is omitted.

The trimming device according to the invention comprises a transverse conveyor which is formed by a number of endless chains 1 only shown partly and which supports suitably spaced dogs 2 of which only a few are illustrated to the left in the figures. The driving direction of the transverse conveyor is illustrated by the arrow 3 in the centre of FIG. 2.

The trimming device is provided with the following means as seen in the driving direction. A root end cutter blade 4 is provided at the left side of the transverse conveyor as seen in the driving direction. A transversely directed roller conveyor formed by rollers 5 has a conveying direction indicated by the arrow 6. The upper surfaces of the rollers 5 are located at a somewhat higher level than the chains 1. A stop 7 is adjustably arranged in line with said roller conveyor 5 and somewhat outside of the right side of the transverse conveyor. A number of measurement flaps 8 are journalled on a shaft 9 in such a way that they can be individually swung upwards from the position shown in FIG. 1. The right sides of the measurement flaps 8 as seen in the driving direction of the conveyor are the sides for stopping and engagement, and the distance between the sides is one length module unit, which can be for example 300mm. At each measurement flap 8 an electric switch means 10 is provided for a purpose which will be closer explained below. In combination with the line of measurement flaps 8 a transversely directed roller conveyor formed by rollers 11 is provided with a driving direction indicated by the arrow 12. A top end cutter blade 13 is provided parallel to said stop 7. An extension line from the cutter blade 13 to the stop 7 will have the lengths, which is less than one length module unit, said line being perpendiculary broken as the cutter blade 13 and the stop 7 are not in the same vertical plane. The distance from said top end cutter blade 13 to each measurement flap 8 is a multiple of the length module unit. A device for turning the pieces of lumber around their own longitudinal axis is only schematically illustrated with the reference number 14, said device being driven preferably at the same pace as the transverse conveyor 1. The turning device 14 can preferably be of the construction described in U.S. Pat. No. 3,759,384. At the turning device 14 the place of a grader 15 is schematically shown. A number of measurement flaps 16 are located having their longitudinal direction aligned with the measurement flaps 8. A further top end cutter blade 17 is provided in the same vertical plane as the top end cutter blade 13. A further turning device 18 is provided of the same kind as the first mentioned turning device 14. A grader has the reference number 19. Measurement flaps 20 are provided in line with said measurement flaps 16. Still another top end cutter blade 21 is located in the same vertical plane as said top end cutter blades 13 and 17. Outside at each top end cutter bade a collector 22,23,24 is provided for cut off pieces.

Ahead of the top end cutter blade 21 as seen in the transport direction a roller conveyor formed by rollers 25 is provided with a transport direction indicated by the arrow 26. In the driving direction of the roller conveyor and outside on the right side of the transverse conveyor displaceable locating stops 27*a–e* are provided, said stops having means which are swingable upwards and downwards. The locating stops 27a-e are spaced by a distance which is equal to one length module unit. In the same plane as the locating stop 27*a*, which is situated most adjacent the transverse conveyor, a top end cutter blade 28 is arranged.

Grading and measuring of pieces of lumber is made in the following way in the trimming device described above. Lumber, preferably boards, arrive to the left end of the trimming device as seen in the figures. Here the root ends are inspected and cut when required by the transverse conveyor 1, which preferably is in continuous action, feeding the piece of board by the dogs 2 to the root end cutter blade 4. During the continued transport of the piece of board B it will arrive to the roller conveyor 5 and be fed laterally in the longitudinal direction of the board against the stop 7. Under guidance against the stop 7 it will come into contact with and lift up a number of measurement flaps 8, whereafter the roller conveyor 11 will move the piece of board in the direction indicated by the arrow 12, so that the root end of the piece of board will come into abutment with the nearest not lifted measurement flap 8. After guidance against said not lifted measurement flap the top end of the piece of board will be cut by the top end cutter blade 13. The piece of board will now have a length which is equal to a multiple of the length module unit, that is the piece of board has a length which is a number of times preferably 300mm, as each measurement flap 8 has a distance to the top end cutter blade 13 which is a multiple of the length module unit as described above. The lifted measurement flaps 8 will bring their respective electric switch means 10 to a closed state, whereby impulses are fed stepwise to a suitable signal storing device or a memory provided at each respective grader 15, 19. The piece of board is transported to the turning device 14, where it will be turned around its own longitudinal axis and inspected on all sides by the grader 15.

If the piece of board is without defects the grader 15 will give an electric impulse to lift the swingable means of the locating stop 27*a*. Hereby the drive force of the roller conveyor 25 on the piece of board will be counteracted and the piece of board will be transported away by the transverse conveyor without further treatment.

If the piece of board must be cut at the top end due to defects or to raise the quality thereof, the grader 15 can now by pressing certain buttons cut off the desired lengths. Hereby an impulse is given to swing up of the means of a locating stop, for example 27*b* if two length module units are to be cut away, so that the piece of board, when arrived on the roller conveyor 25, will be fed until its top end will abut the lifted means of the locating stop 27*b*, and after that said means will guide the top end until the piece of board will reach the top end cutter blade 28 and the top end will be cut away.

However if the grader finds that a greater length, for example two length module units more than what is possible by setting the outermost locating stop 27*e*, must be cut, the grader 15 will pull the piece of board towards himself, so that the root end in this case will move past two measurement flaps 16 towards the grader and under guidance of the root end on that measurement flap which has swung down closest to the root end surface the grader can make a cut by the top end cutter blade 17. The additional required cut is made by setting one of the locating stops 27*b–e* and by the top end cutter blade 28. The cut by the top end cutter blade 28 can not be more than five length module units as a rule, and if a longer cut is required, the grader can pull the end of the piece of board and make a preliminary cut by the top end cutter blade 17.

In the shown example of embodiment the graders 15 and 19 have the same function and the same equipment and each of them inspects every other piece of board. There may also be for example three graders, each of which will inspect every third piece of board.

After the cutting of the top ends by one or several top end cutter blades the lumber will pass marking apparatus (not shown) which are situated ahead of the top end cutter blade 28 as seen in the transport direction, and to a next transverse conveyor or a lumber collecting device.

The following advantages are obtained by the method and the device according to the invention. Immediately after the root end cut a top end cut is made which is smaller than one length module unit, and will give the piece of lumber a length of exactly one multiple of a length module unit. As a normal top end cut, especially in thick lumber, in most cases is shorter than one length module unit, only this top end cut will be necessary, whereafter the lumber can pass through the whole trimming device without any lateral displacements. The first top end cut which gives the lumber a length of a multiple of the length module unit, makes is possible thereafter to adjust the lumber directly from the top end surfaces of the lumber when additional cuts are to be made. The top end surfaces will thus be used as O-surfaces at the measurement. All top end cutter blades are located in the same plane, which facilitates the mounting and location thereof and of the measurement flaps and locating stops, the later means depending on the top end cutter blades as regards location. The positioning of the locating stops outside of the transverse conveyor gives a freer choice of construction and makes them easier to mount, compared to if they were positioned in the transverse conveyor in the usual manner. In the embodiment described above a continuous central line is produced for the device independently of how long the top end cuts are. Consequently the device according to the invention requires a house, which need not be as broad as the houses that are required by devices previously known.

The device according to the invention can be modified within the scope of the invention as regards details. Other saw means than cutter blades can be used, for example, and the length module unit can be any length unit or part thereof. The measurement flaps can be arranged to be pressed down instead of lifted by passing lumber. The locating stops can be so constructed, that they can be set into an active position dierctly by the grader.

What we claim is:

1. Method for grading and measuring lumber during transport thereof in a running direction through a trimming device in which the lumber is cut at both root and top ends, said method comprising the steps of:

A. initially making the root end cut,

B. transporting the remanent thereafter in a direction transverse to its running direction to a stop located in its path so as to fix the location at which the first top end cut is made, C. making a first top end cut by severing from the top end a length less than one length module unit to provide a remanent portion which is a lengthwise multiple of a length module unit, D. rotating the resulting remanent portion for inspection thereof to determine the presence or absence of defects, E. thereafter transporting said inspected remanent portion to a final cutting device and, F. if defects have been detected, serving said inspected remanent portion to any of several length module units by making an additional top end cut with said final cutting device.

2. The method as claimed in claim 1 in which rotation of the resulting remanent portion for inspection thereof is performed downstream from the location of the first top end cut.

3. The method as claimed in claim 2 in which a second top end cut is effected subsequent to inspection and prior to the final cutting device, said second top end cut being made at a location on the inspected remanent which is equal to a multiple of the length module unit.

4. The method as claimed in claim 2 in which the inspected remanent portion is trimmed after inspection and prior to the final cutting device by severing a section thereof therefrom which is equal to a multiple of the length module unit.

5. The method a claimed in claim 1 in which the remanent subsequent to the first transporting of the remanent and prior to the first top end cut, is transported transversely of the running direction but in a direction opposite to the first transverse transport direction and one of a plurality of measuring flap stop members is brought into its resultant path, positioning said one of said flap stop members at a location relative to the cutter for making the first top end cut a multiple of the length module unit so that the first top end cut is effective to sever a portion less than the said length module unit.

6. The method as claimed in claim 1 in which the additional top end cut is made to a length determined by selective operation of adjustable stop means.

7. A trimming device for cutting, grading and measuring successive lumber pieces to lengths which are multiples of a predetermined length module unit and comprising, running conveyor means having lumber arranged transversely thereof and carried therebyy in a running direction, first cutter means located along one side of said running conveyor means for making a root end cut upon said lumber, first roller conveyor means operable in a direction transverse to the running direction to intercept said lumber pieces and direct same transversely of said running direction, stop means positioned at the delivery end of said roller conveyor means to intercept said lumber pieces, said stop means being located at a predetermined location at the other side of said running conveyor means, a first plurality of stop means arranged in a line transverse of said running conveyor means and downstream of said roller conveyor means, second roller conveyor means positioned downstream of but adjacent to said first roller conveyor means and operating in a direction opposite to said delivery direction of said first roller conveyor means and operable with one of said plurality to fix the degree of the first top end cut, second cutter means located immediately downstream of said second roller conveyor means, a turning device for rotating said lumber piece subsequent to the first top end cut performed thereupon, and third roller conveyor means positioned in intercepting relation to the lumber pieces at a location downstream of said turning device and operating in a direction transverse to said running direction and the same as the delivery direction of said first roller conveyor means, adjustable stop means arranged in the delivery path of said third roller conveyor means, and third cutter means arranged coplanar with one stop of said adjustable stop means and operable to sever a length of said lumber piece presented thereto equal to a multiple of said length module unit.

8. The trimming device as claimed in claim 7 in which said second cutter means and said third cutter means are coplanar in vertical planes along the running conveyor and on the said other side of said running conveyor.

9. The trimming device as claimed in claim 7 in which said first plurality of stop members comprise a plurality of measuring flaps each having switch means associated therewith and spaced one from the other a distance equal to at least one length module unit.

10. The trimming device as claimed in claim 7 in which the distance from said first stop and one of said plurality of stop members is equal to a multiple of said length module unit plus a length less than one of said length module units.

11. The trimming device as claimed in claim 7 in which said second cutting means comprises at least one cutter blade arranged in the running direction of said running conveyor means, said cutter blade being arranged in the same vertical plane as said first cutter means, a second plurality of stop members arranged in a line adjacent with said cutter blade and across said running conveyor, the distance of each of the second plurality of stop members to the cutter blade being equal to a multiple of the length module unit.

12. A trimming device for trimming, grading and measuring lumber into lengths which are multiples of a length module unit by effecting root and top end cuts thereupon and including running conveyor means for carrying lumber pieces arranged transversely thereupon, a root end cutter blade, at least one top end cutter blade, plural spaced roller conveyor means located in intercepting relation to said running conveyor means, at least one set of measurement flaps located in a line across the running conveyor means and stop means located at the delivery ends of said roller conveyor means, said roller conveyor means including a first roller conveyor located immediately downstream of said root end cutter blade, said root end cutter blade being located along one side of said running conveyor means, said stop means including a first stop in a vertical plane intercepting the transport direction of said first roller conveyor, said top end cutter blade located on the other side of said running conveyor downstream of said first stop and occupying a vertical plane parallel with but spaced inwardly toward said running conveyor a distance equal to less than a length module unit, a second roller conveyor located downstream of said first roller conveyor but upstream of said top end cutter blade and operable in a transverse direction opposite to that of said first roler conveyor, said set of measuring flaps being operable on pieces carried by said second roller conveyor selectively to limit the return transverse movement thereof whereby to present to said top end cutter blade a portion of lumber for severence that is less than a length module unit, each one of said measurement flaps being spaced from the next adjacent measurement flap a distance equal to said length module unit, and a turning device positioned downstream of said top end cutter blade, a second set of measurement flaps downstream of said turning device but adjacent thereto, each of said second line of measurement flaps being spaced from the others by a distance of one length module unit, and an additional top end cutter blade disposed in the same vertical plane as said other top end cutter blade but downstream of said second set of measurement flaps, said second set of measuring flaps and said second top end cutter blade cooperating for selective additional trimming of said first turned lumber pieces, whereby additional trimming is provided for when necessary.

13. A trimming device for trimming, grading and measuring lumber into lengths which are multiples of a length module unit by effecting root and top end cuts thereupon and including running conveyor means for carrying lumber pieces arranged transversely thereupon, a root end cutter blade, at least one top end cutter blade, plural spaced roller conveyor means located in intercepting relation to said running conveyor means, at least one set of measurement flaps located in a line across the running conveyor means and stop means located at the delivery ends of said roller conveyor means, said roller conveyor means including a first roller conveyor located immediately downstream of said root end cutter blade, said root end cutter blade being located along one side of said running conveyor means, said stop means including a first stop in a vertical plane intercepting the transport direction of said first roller conveyor, said top end cutter blade located on the other side of said runnning conveyor downstream of said first stop ond occupying a vertical plane parallel with but spaced inwardly toward said running conveyor a distance equal to less than a length module unit, a second roller conveyor located downstream of said first roller conveyor but upstream of said top end cutter blade and operable in a transverse direction opposite to that of said first roller conveyor, said set of measuring flaps being operable on pieces carried by said second roller conveyor selectively to limit the return transverse movement thereof whereby to present to said top end cutter blade a portion of lumber for severance that is less than a length module unit, each one of said measurement flaps being spaced from the next adjacent measurement flap a distance equal to said length module unit, an inspection station downstream of said top end cutter blade and means for turning the lumber pieces about the elongate axis therof, said turning means located in intercepting relation to the running conveyor downstream of said one top end cutter blade and aligned with aid inspection station and means for effecting selective corrective trimming of the inspected pieces.

14. The trimming device as claimed in claim 13 in which said means for effecting corrective trimming of the inspected pieces comprise a second set of measurement flaps downstream of said cutting means but adjacent thereto, each of said second line of measurement flaps being spaced from the others by a distance of one length module unit and a second top end cutter blade disposed in the same vertical plane as said first top end cutter blade but downstream of said second set of measuring flaps, said second set of measuring flaps and said second top end cutter blade operating for additional trimming of said first turned lumber pieces when necessary.

15. A trimming device for trimming, grading and measuring lumber into lengths which are multiples of a length module unit by effecting root and top end cuts thereupon and including running conveyor means for carrying lumber pieces arranged transversely thereupon, a root end cutter blade, at least one top end cutter blade, plural spaced roller conveyor means located in intercepting relation to said running conveyor means, at least one set of measurement flaps located in a line across the running conveyor means and stop means located at the delivery ends of said roller conveyor means, said roller conveyor means including a first roller conveyor located immediately downstream of said root end cutter blade, said root end cutter blade being located along one side of said running conveyor means, said stop means including a first stop in a vertical plane intercepting the transport direction of said first roller conveyor, said top end cutter blade located on the other side of said running conveyor downstream of said first stop and occupying a vertical plane parallel with but spaced inwardly toward said running conveyor a distance equal to less than a length module unit, a second roller conveyor located downstream of said first roller conveyor but upstream of said top end cutter blade and operable in a transverse direction opposite to that of said first roller conveyor, said set of measuring flaps being operable on pieces carried by said second roller conveyor selectively to limit the return transverse movement thereof whereby to present to said top end cutter blade a portion of lumber for severence that is less than a length module unit, each one of said measurement flaps being spaced from the next adjacent measurement flap a distance cuqal to said length module unit, and a third roller conveyor located downstream of said top end cutter blade, a lineal series of parallel locating stops located at the said other side of said running conveyor adjacent thereto and arranged in planes normal to the path of travel of said second roller conveyor at its delivery end, one of said locating stops being coplanar with said top end cutter blade, the remaining locating stops being spaced one from the other a distance equal to one length module unit, each of said locating stops independently being capable of being placed in intercepting relation relative to the top end of the lumber piece carried by said third roller conveyor and an additional top end cutter blade capable of being located downstream of and in a plane coplanar with said one locating stop.

* * * * *

UNITED STATES PATENT AND TRADEMARK OFFICE

CERTIFICATE OF CORRECTION

PATENT NO. : 4,023,605

DATED : May 17, 1977

INVENTOR(S) : NILS ERIK HELLSTROM et al

It is certified that error appears in the above-identified patent and that said Letters Patent are hereby corrected as shown below:

Column 3, line 18 change "lengths" to --length a--;
Column 5, line 55 change "serving" to --severing--

Signed and Sealed this

*Sixth* Day of *September 1977*

[SEAL]

*Attest:*

RUTH C. MASON
*Attesting Officer*

LUTRELLE F. PARKER
*Acting Commissioner of Patents and Trademarks*